United States Patent [19]

Bazyk

[11] 4,157,131

[45] Jun. 5, 1979

[54] BOAT BOARDING LADDER

[76] Inventor: Robert J. Bazyk, 4161 Eastern, Nevada Las Vegas Mission, Box 19743, Las Vegas, Nev. 89119

[21] Appl. No.: 884,821

[22] Filed: Mar. 9, 1978

[51] Int. Cl.[2] ..... E06C 1/36; E06C 7/48

[52] U.S. Cl. ..... 182/206; 182/165

[58] Field of Search ..... 182/206, 150, 194, 197, 182/165

[56] References Cited

U.S. PATENT DOCUMENTS

| | | | |
|---|---|---|---|
| 3,120,290 | 2/1964 | Kamrath | 182/206 |
| 3,498,410 | 3/1970 | Storch | 182/206 |
| 3,792,750 | 2/1974 | Madison | 182/206 |

FOREIGN PATENT DOCUMENTS

| | | | |
|---|---|---|---|
| 1480212 | 4/1967 | France | 182/206 |

*Primary Examiner*—Reinaldo P. Machado
*Attorney, Agent, or Firm*—Richards, Harris & Medlock

[57] ABSTRACT

A boat boarding ladder for engagement to the gunwale of a boat includes a U-shaped frame having upstanding legs attached at one end by a bottom rung. A U-shaped support member is pivotally attached to the upper end of the legs of the frame. A bar is attached between the legs of the frame intermediate of the pivotal connection of the support member to the frame and the frame rung. The legs of the support member are curved such that the support member when pivoted against the bar attached across the legs of the frame forms a receiving area between the support member and the frame for attachment of the ladder to the gunwale of a boat. A Y-shaped brace is pivotally attached to the legs of the frame intermediate of the attachment of the support member and the rung to the legs of the frame. A chain is attached between the legs of the frame and the brace member and positions the brace member out of the plane of the frame and against the hull of the boat at an incline relative to the boat.

3 Claims, 4 Drawing Figures

BOAT BOARDING LADDER

BACKGROUND OF THE INVENTION

1. Field of the Invention

The present invention relates to boat boarding ladders and more particularly to a boarding ladder which may be mounted at any position along the gunwale of the boat.

2. Prior Art

Boat boarding ladders are regularly used for boarding large and small water craft from the water. Although used regularly in scuba diving or water skiing, the ladders provide assistance for boarding boats at any time entry into the boat from the water or from a surface below the gunwale of the boat is desired.

In the past, boarding ladders have normally been of the hook ladder design which provides a frame having a curved upper portion which is hooked over the gunwale of a boat. This design supports a plurality of rungs at the side of the boat to facilitate boarding.

This ladder design, as well as other modifications of this design, have been less than satisfactory in that the ladder does not provide a steady attachment to the boat and often will move or slide when engaged during entry into the boat. Further, prior art boarding ladders have not provided an uncomplicated and inexpensive structure which provides the safety factors of, a positive attachment to the boat, is adjustable to provide various angles of incline relative to the hull of the boat, and is collapsible for easy storage. Prior designs also have not incorporated characteristics above described into one package having at the same time the versatility necessary to position the ladder at any point along the gunwale and still allowing easy transfer from one boat to another.

SUMMARY OF THE INVENTION

The present invention is directed to a boarding ladder which overcomes many of these deficiencies heretofore experienced in prior art boat ladders. In accordance with one embodiment of the invention, a boarding ladder is provided for engagement to the gunwale or deck rail of a boat and includes a U-shaped frame having a pair of upstanding legs connected by a bottom rung. An intermediate rung is attached between the upstanding legs of the frame and provides a second step. The upper ends of the frame remote from the bottom rung are supported in a spaced relationship by a bar attached at its opposite ends near the upper end of the upstanding legs of the frame. A U-shaped support member is pivotally attached to the upper ends of the upstanding legs of the frame above the bar member attached between the upstanding legs of the frame. The U-shaped member includes legs which are curved out of the plane of the frame and are connected by a transverse bar portion.

A Y-shaped brace is pivotally attached to the upstanding legs of the frame at points just below the attachment of the intermediate rung to the frame. The brace includes two curved members joined near their ends remote from their attachment to the frame. Chain links are attached between the upstanding legs of the frame to the brace to limit the rotation of the brace relative to the frame. In a preferred embodiment of the invention, all of the members are constructed from tubular conduit made from an appropriate metal alloy such as aluminum or the like.

In use of the boarding ladder of the present invention, the U-shaped support frame is rotated to bear against the bar attached to the upper end of the upstanding legs of the frame to form a receiving V-shaped area between the support member and the frame. The boarding ladder is positioned over the side wall of the boat such that the support member is inside the hull and the legs of the frame are outside the hull with the side wall nested therebetween. Rotation of the lower portion of the frame toward the boat is prevented by engagement of the brace against the boat hull. Chain links, attached between the frame legs and the brace, prevent the rotation of the brace toward the frame thereby stabilizing the position of the boarding ladder relative to the boat. By adjustment of the length of the chain links, the angle or incline of the boarding ladder may be adjusted relative to the hull of the boat.

DESCRIPTION OF THE DRAWINGS

For a more complete understanding of the present invention, and for further details and advantages thereof, reference is now made to the following description taken in conjunction with the accompanying drawings, in which.

DESCRIPTION OF THE PREFERRED EMBODIMENT

Figure 1:
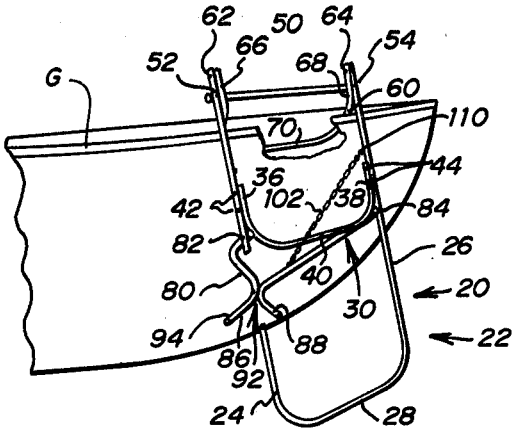
FIG. 1 is a perspective view of the boat boarding ladder of the present invention mounted on the starboard side of a boat.

The present invention provides a boat boarding ladder which may be mounted at any position along the gunwale or deck rail of small or large water craft. Referring to FIG. 1, the boarding ladder 20 includes a U-shaped frame 22 made from a single piece of tubular conduit, such as aluminum or other alloy metals. Frame 22 includes left and right upstanding legs 24 and 26, respectively, with a bottom rung 28 therebetween. Left and right legs 24 and 26 are connected by way of an intermediate rung 30. Rung 30 is of a U-shaped design made from a tubular alloy metal, such as aluminum or the like, and includes left and right legs 36 and 38 interconnected by a transverse step portion 40.

Rung 30 is atached to frame 22 by appropriate bolts 42 and 44. Bolts 42 are engaged through leg 36 of rung 30 and leg 24 of frame 22 to fixedly attach one side of rung 30 to the frame, and bolts 44 are engaged through leg 38 of rung 30 and leg 26 of frame 22 to complete the attachment of rung 30 to frame 22. Step portion 40 of rung 30 is substantially parallel to bottom rung 28 of frame 22 and is positioned intermediate of rung 28 and the upper end of legs 24 and 26 remote from rung 28.

Referring still to FIG. 1, the upper ends of frame 22 remote from rung 28 are supported in a spaced relationship by a bar 50 attached at its opposite ends near the upper ends of legs 24 and 26 by bolts 52 and 54, respectively. Bar 50 is also of the same tubular construction as frame 22 and rung 30.

An upper U-shaped support member 60 is pivotally attached by bolts 62 and 64 to the upper end of legs 24 and 26 of frame 22. U-shaped member 60 includes left and right legs 66 and 68 which are curved out of the plane of frame 22 (FIG. 2) and are connected by a transverse portion 70. Support member 60 is constructed of a continuous tubular conduit from an appropriate metal alloy such as aluminum or the like.

A Y-shaped brace 80 is pivotally attached by appropriate fasteners 82 and 84 to legs 24 and 26, respectively, of frame 22 at points just below the attachment of rung 30 to frame 22. Brace 80 includes two curved members 86 and 88 joined near their ends remote from attachment to frame 22 by a fastener 90. The leg of Y brace 80 below their attachment at fastener 90 is separated to form a receiving V 92. Protective caps 94 are fitted on the ends of curved members 86 and 88 remote from frame 22 to provide the brace with a better gripping surface for engagement against the boat and to protect the hull of the boat from damage by the brace. Curved members 86 and 88 are also constructed from a tubular conduit of an appropriate alloy metal such as aluminum or the like.

Chain links 100 and 102 are attached at one of their ends by appropriate fittings to legs 24 and 26, respectively. Links 100 and 102 are attached at their opposite ends to members 86 and 88 of brace 80. As can best be seen in FIG. 2, the upper end of chain 102 is attached to leg 26 by a bolt 110 with the opposite end of chain 102 being received in eye-bolt 112. The lengths of chains 100 and 102 are dimensioned to limit the rotation of brace 80 such that lower support is positioned against the side of the boat as will be discussed hereinafter in greater detail.

Figure 2:
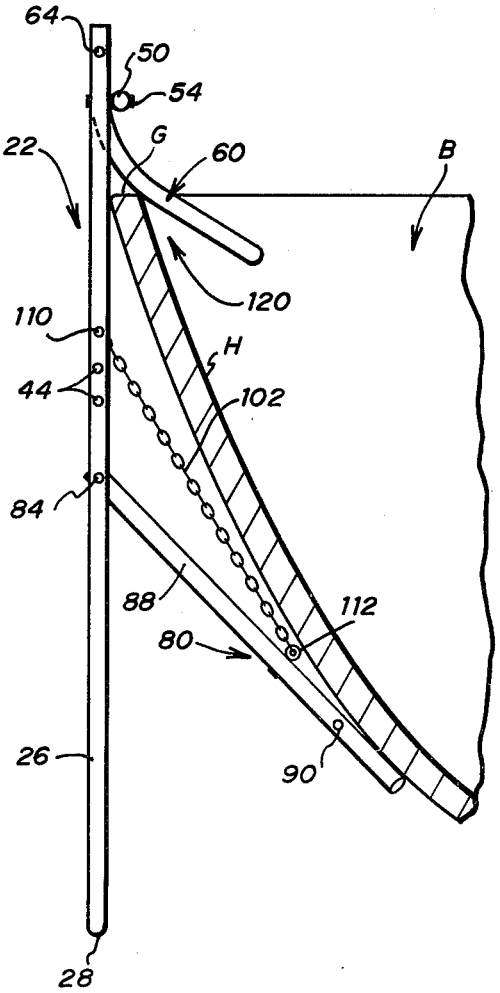
FIG. 2 is a section view taken near the bow of the boat looking rearwardly showing the boarding ladder of FIG. 1.

Referring now to FIGS. 1 and 2, boarding ladder 20 is shown mounted over the gunwale of a boat B with the U-shaped support member 60 rotated in a counterclockwise direction as viewed from FIG. 2 such that legs 66 and 68 of member 60 bear against bar 50. The boarding ladder is positioned over the gunwale G of boat B such that legs 66 and 68 of member 60 are to the inside of the hull H and legs 24 and 26 of frame 22 are to the outside. As can be appreciated by viewing FIG. 2, frame 22 and member 60 provide a receiving V area 120 therebetween which can accommodate various wall thicknesses encountered in different water craft. The boarding ladder is simply positioned over the gunwale G until the upper portion of the hull is nested between member 60 and frame 22. Because member 60 is prevented from rotating about its pivotal connection at bolts 62 and 64 by bar 50, further descent of the ladder relative to gunwale G is prevented by support 60.

Further, rotation of the lower portion of frame 22 toward boat B is prevented by the engagement of brace 80 against the hull H. Chains links 100 and 102 prevent the rotation of brace 80 toward frame 22 thereby stabilizing the position of boarding ladder 20 relative to boat B.

It may be appreciated that by adjustment of the length of chain links 100 and 102, the angle or incline of the boarding ladder may be adjusted relative to the hull H of boat B. Specifically, by shortening chain links 100 and 102, brace 80 is positioned to project further from frame 22 and thus extend frame 22 further from hull H. Likewise, by lengthening chain links 100 and 102, brace 80 is permitted to rotate closer to frame 22 of boarding ladder 20 thus permitting the ladder to move closer toward hull H of the boat.

Figure 3:
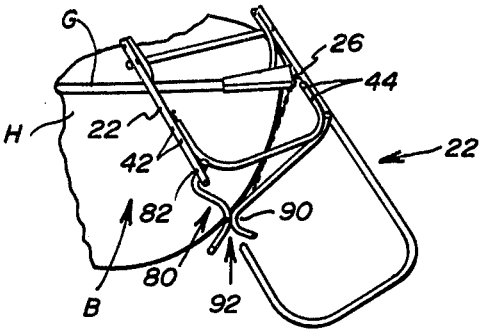
FIG. 3 is a perspective view of the boarding ladder of the present invention mounted on the bow of the boat.

FIG. 3 illustrates the positioning of boarding ladder 20 on the bow of boat B. In this arrangement, legs 66 and 68 of support member 60 are placed on the inside of hull H while legs 24 and 26 of frame 22 are positioned outside. Ladder 20 is prevented from rotating downwardly by the engagement of brace 80 against hull H. As can be seen in FIG. 3, the Y-shaped arrangement of brace 80 permits the engagement of the boarding ladder against the bow of boat B such that curved members 86 and 88 are engaged on opposite sides of the bow. In this way, the ladder is stabilized to prevent side to side movement relative to the boat.

Figure 4:
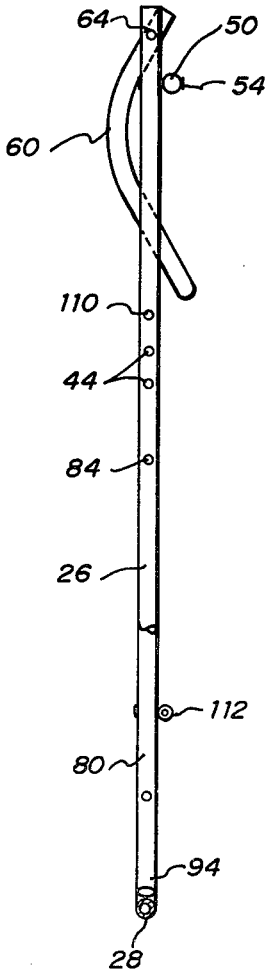
FIG. 4 is a side view of the boat ladder of the present invention partially broken away showing the boat ladder in a folded or stored position.

FIG. 4 illustrates the boarding ladder of the present invention in the collapsed or stored position with leg 26 partially broken away to reveal brace 80. In this position, brace 80 is rotated about bolts 82 (FIG. 1) and 84 such that the brace is in the plane of frame 22. Similarly, support member 60 is rotated about bolts 52 (FIG. 1) and 54 to a position substantially in line with frame 22.

Thus, the present invention provides a boat boarding ladder having a frame with appropriate rungs thereon and a support member pivotally attached at the upper end of the frame. The support member cooperating with the frame and a limit bar attached to the frame to form a receiving area for engagement of the gunwale of a boat on which the ladder is mounted. The frame includes a brace member pivotally attached therefrom for engagement against the hull of the boat to properly position the frame at an incline away from the boat to facilitate entering the boat by way of the ladder.

Although preferred embodiments of the invention have been described in the foregoing detailed description and illustrated in the accompanying drawings, it will be understood that the invention is not limited to the embodiments disclosed, but is capable of numerous rearrangements, modifications, and substitutions of parts and elements without departing from the spirit of the invention.

For example, in the primary embodiment, the frame, intermediate rung, bar and brace have been described as tubular conduits made from an appropriate metal alloy such as aluminum. Of course, it will be understood that any other material and cross sectional form possessing sufficient structural strength can be substituted for that identified without departing from the present invention. The present invention is therefore intended to encompass such rearrangements, modifications and substitutions of parts and elements as fall within the scope of the appended claims.

What is claimed is:

1. A boat boarding ladder for engagement to the gunwale of a boat, comprising:

a frame having at least one rung thereon, said frame member including upstanding legs interconnected at one end by said rung, a support member pivotally attached adjacent one end of said frame, said support member including a U-shaped member having side legs interconnected by a transverse member, said legs of said support member being pivotally attached to said upstanding legs of said frame and being curved out of the plane of said frame, and means attached to said frame for arresting the rotation of said support member relative to said frame such that the gunwale of the boat may be engaged between said support member and said frame with the support member within the boat and the frame outside the boat.

2. The boarding ladder according to claim 1 wherein said means for arresting the rotation of said support member includes a bar member attached between the upstanding legs of said frame and intermediate the pivotal attachment of said support member from said frame and said rung.

3. A boat boarding ladder, comprising:

a frame having upstanding legs interconnected at one end by a rung member, a U-shaped support member having side legs curved out of the plane of the frame interconnected by a transverse member, said support member being pivotally attached at its legs to said frame, a bar member attached between the upstanding legs of the frame and intermediate the pivotable attachment of said support member and the rung on said frame, a brace member pivotally attached from said frame at points intermediate of the points of attachment of said support member to said frame and said rung, and means for limiting the rotation of said brace member toward said frame such that said brace member projects outwardly from said frame.

* * * * *